US010850897B2

(12) United States Patent
Charm

(10) Patent No.: US 10,850,897 B2
(45) Date of Patent: Dec. 1, 2020

(54) CONTAINER WITH CHILD-RESISTANT LID RELEASE AND MICRODOSING

(71) Applicant: PLANET CANIT, LLC, Highland Park, IL (US)

(72) Inventor: Hui Ho Charm, Kwai Chung (HK)

(73) Assignee: Planet Canit, LLC, Highland Park, IL (US)

( * ) Notice: Subject to any disclaimer, the term of this patent is extended or adjusted under 35 U.S.C. 154(b) by 0 days.

(21) Appl. No.: 15/719,336

(22) Filed: Sep. 28, 2017

(65) Prior Publication Data

US 2018/0086518 A1 Mar. 29, 2018

Related U.S. Application Data

(60) Provisional application No. 62/401,050, filed on Sep. 28, 2016.

(51) Int. Cl.
*B65D 50/04* (2006.01)
*B65D 25/04* (2006.01)
(Continued)

(52) U.S. Cl.
CPC ..... *B65D 50/04* (2013.01); *B26D 1/0006* (2013.01); *B26D 3/30* (2013.01); *B65D 25/04* (2013.01);
(Continued)

(58) Field of Classification Search
CPC ..... B65D 50/04; B65D 51/24; B65D 43/26; B65D 25/04; B65D 43/22; B65D 43/163; B26D 1/0006; B26D 2001/006
See application file for complete search history.

(56) References Cited

U.S. PATENT DOCUMENTS 4,697,344 A 10/1987 Leopoldi
4,969,573 A * 11/1990 Dupuis ..... A45D 40/0068 220/255
(Continued)

FOREIGN PATENT DOCUMENTS

CN 202069859 U 12/2011
CN 204208034 U 3/2015
DE 9306135 U1 * 9/1993 ..... A61J 1/03

OTHER PUBLICATIONS

The International Search Report and the Written Opinion of the International Searching Authority, dated Dec. 26, 2017, in corresponding International Application No. PCT/US17/54131, 23 pages.

*Primary Examiner* — Jonathan G Riley
(74) *Attorney, Agent, or Firm* — Foley & Lardner LLP

(57) ABSTRACT

A container tin includes a container base with one or more storage compartments for ingestible products, and a reclosable lid with child-resistant (CR) features. The container incorporates mechanisms for creating and storing microdoses of edibles or medicaments. The CR reclosable container contains closure mechanisms, such as a latching pin and catch assembly, that present difficulties to a child attempting to open the container but that a properly trained adult can operate without undue problems to open the container. The container includes a cutter at the lid and a cutting support assembly at the base. A user places a product on the cutting support assembly, then closes the container lid to cut the product in two. This procedure can be used with *cannabis* products or similar psychoactive products to create microdoses below a threshold quantity that creates a perceptible psychoactive effect in the user.

16 Claims, 16 Drawing Sheets

(51) Int. Cl.

| | |
|---|---|
| ***B65D 43/16*** | (2006.01) |
| ***B65D 43/26*** | (2006.01) |
| ***B65D 51/24*** | (2006.01) |
| ***B26D 1/00*** | (2006.01) |
| ***B65D 43/22*** | (2006.01) |
| ***B26D 3/30*** | (2006.01) |

(52) U.S. Cl.
CPC ..... *B65D 43/163* (2013.01); *B65D 43/22* (2013.01); *B65D 43/26* (2013.01); *B65D 51/24* (2013.01); *B26D 2001/006* (2013.01)

(56) References Cited

U.S. PATENT DOCUMENTS

| | | | | |
|---|---|---|---|---|
| 5,118,021 | A * | 6/1992 | Fiocchi | A61J 7/0007 225/103 |
| 5,533,240 | A * | 7/1996 | Murai | A44B 11/263 24/615 |
| 6,601,746 | B2 * | 8/2003 | Buckley | A61J 7/0007 206/528 |
| 7,000,815 | B1 * | 2/2006 | Tipton | A61J 7/0007 225/103 |
| 7,243,826 | B2 | 7/2007 | Darst | |
| 8,292,101 | B1 | 10/2012 | Bragg et al. | |
| D859,686 | S * | 9/2019 | Charm | D24/224 |
| D887,703 | S * | 6/2020 | Charm | D3/203.3 |
| 2003/0019900 | A1 * | 1/2003 | Dienst | A61J 7/0007 225/104 |
| 2004/0007595 | A1 | 1/2004 | Stull et al. | |
| 2005/0051587 | A1 * | 3/2005 | Kan | A61J 7/0007 225/103 |
| 2005/0067452 | A1 | 3/2005 | Darst | |
| 2006/0096984 | A1 * | 5/2006 | Bandoh | B65D 83/08 220/254.5 |
| 2008/0011803 | A1 | 1/2008 | Petrie et al. | |
| 2008/0075772 | A1 * | 3/2008 | Solomon | A61K 9/2072 424/464 |
| 2009/0183373 | A1 | 7/2009 | Suhr | |
| 2015/0021326 | A1 | 1/2015 | Giraud et al. | |
| 2015/0315532 | A1 * | 11/2015 | Bergbohm | B65D 43/16 220/315 |
| 2017/0137184 | A1 * | 5/2017 | Burek | B65D 43/162 |
| 2017/0273868 | A1 * | 9/2017 | Wang | A61J 7/0007 |
| 2018/0086518 | A1 * | 3/2018 | Charm | B65D 51/24 |

* cited by examiner

CONTAINER WITH CHILD-RESISTANT LID RELEASE AND MICRODOSING

CROSS-REFERENCE TO RELATED APPLICATION

The present application claims benefit of U.S. Provisional Application 62/401,050, filed Sep. 28, 2016, entitled CONTAINER WITH CHILD-RESISTANT LID RELEASE, the entire contents of which are hereby incorporated by reference.

FIELD OF THE DISCLOSURE

The subject matter disclosed herein relates generally to containers, and more particularly to child-resistant reclosures and microdosing mechanisms for such containers.

BACKGROUND

In many applications, reclosable containers are designed with child safety as a paramount consideration, given various incidents of adverse reaction to the consumption of marijuana involving children. An example is child-safe *cannabis* containers. One goal of the containers of the present disclosure is to provide child-resistant packaging for *cannabis* products. Another goal is to provide child-resistant packaging that can be opened without undue problems by adults who have been trained in how to access the packaged contents.

Another consideration in safe and efficacious use of *cannabis* products and other psychoactive products, whether for medicinal or recreational purposes, is administration of product doses. In consumption of marijuana, one approach is ingestion of a solid ingestible material containing *cannabis*. A goal of the present disclosure is to provide packaging for *cannabis* products and other solid ingestible products that enables creation and storage of product serving sizes and doses appropriate to given users. Another goal is to facilitate microdosing of *cannabis* products and similar solid ingestible portions of other psychoactive products.

SUMMARY

This disclosure addresses the requirements of child-resistant packaging in reclosable container "tins," which can store *cannabis* products or other psychoactive products in full servings or in microdoses. A container with a microdosing mechanism includes a container base, and a container lid moveably coupled to the container base for movement between an open configuration of the container and a closed configuration of the container. The container includes at least one compartment for storing a plurality of discrete portions of the solid ingestible material containing *cannabis* or other psychoactive substance. The container includes a cutting support member configured to support one of the discrete portions during cutting, and a cutter configured to cut the discrete portion into two parts during movement of the container from the open configuration toward the closed configuration.

Conventionally, metal container tins do not have a child-resistant lid. In an embodiment of the present disclosure, the container tin has a metal body and a metal child-resistant lid. The container tin uses plastic components in the interior of the container tin, but the exterior of the container tin comprises metal, thereby giving an appearance of an all-metal container tin with a child-resistant lid.

In an embodiment, the cutting support member is attached to or integral with the container base, and the cutter is attached to or integral with the container lid. In an embodiment, the container is a reclosable container and the container lid is pivotally coupled to the container base by a hinge for movement between the opened configuration of the container and the closed configuration of the container.

In an embodiment, the cutter is a V-profile cutting blade. In an embodiment, the cutting support member is aligned with the V-profile cutting blade during the movement from the open configuration toward the closed configuration of the container.

In an embodiment of a child-resistant container tin, the container tin includes a lid with a closure mechanism that requires two simultaneous actions to open the container. These actions include displacing an actuating member to convert the container from a locked configuration to an unlocked configuration, and exerting upward pressure at a prescribed location at the rim of the lid while the actuating member is held at a second (actuated) position. Either of these actions taken alone will not suffice to open the container. The child-resistant container of the present disclosure presents substantial challenge to children in opening the container.

In an embodiment of a child-resistant container, the container includes a container base including a first rim and a catch surface. The container further includes a container lid that includes a latch mechanism and a second rim. One of the first rim and the second rim includes a protrusion that engages the other of the first rim and the second rim to prevent raising the container lid. In a locked configuration of the container the latch mechanism abuts against the catch surface of the container base to prevent raising of the lid, while in an unlocked configuration of the container the latch mechanism does not abut against the catch surface and does not prevent raising of the lid. The child resistant container further includes an actuating member configured to be displaced between a first position and a second position. Displacing the actuating member from the first position to the second position causes the latch mechanism to move from the locked configuration to the unlocked configuration. In a child resistant procedure for opening the container, a user manually displaces the actuating member from the first position to the second position and simultaneously exerts an upward manual force on the container lid adjacent the flange, thereby raising the container lid from the container base to open the container.

In an embodiment of the child-resistant container, the actuating member comprises first and second buttons movably mounted at first and second sides of the container base. In another embodiment, the actuating member comprises a shift button slidably mounted at a top surface of the container lid. In an embodiment, the catch surface comprises a horizontal flange surface of a catch plate at the interior of the container base. In an embodiment, the latch mechanism comprises a latch pin secured to the container lid, which engages the horizontal flange surface of the catch plate when the container is in the locked configuration.

In an embodiment, a container comprises a container base comprising at least one compartment for storing a plurality of discrete portions of a solid ingestible food or medicament (e.g., a psychoactive substance), and further comprising a cutting support member configured to support one of the discrete portions of the solid ingestible food or medicament during cutting; and a container lid moveably coupled to the container base for movement from an open configuration of the container to a closed configuration of the container, said container lid comprising a cutter configured to cut the one of the discrete portions of the solid ingestible food or medicament supported on the cutting support member into a plurality of parts during the movement from the open configuration of the container toward the closed configuration of the container.

In an embodiment, a container comprises a container base; a container lid moveably coupled to the container base for movement from an open configuration of the container to a closed configuration of the container; a first compartment for storing one or more discrete portions of a solid ingestible material; a cutting support member configured to support one of the one or more discrete portions of the solid ingestible material during cutting; and a cutter configured to cut the one of the discrete portions of the solid ingestible material supported on the cutting support member into two parts during the movement from the open configuration of the container toward the closed configuration of the container.

A child-resistant container comprising a container base including a first rim and a catch surface; a container lid including a second rim and a latch mechanism; and an actuating member configured to be displaced between a first position and a second position, wherein displacing the actuating member from the first position to the second position causes the latch mechanism to move from a locked configuration of the container to an unlocked configuration of the container; wherein in the locked configuration the latch mechanism abuts against the catch surface of the container base to prevent raising of the lid, and in the unlocked configuration the latch mechanism does not abut against the catch surface of the container base and does not prevent raising of the lid; wherein in a closed configuration of the container the first rim is in mating engagement with the second rim, and one of the first rim and the second rim includes a protuberance that engages the other of the first rim and the second rim to provide limited resistance to raising the container lid from the container base; and wherein when a user manually displaces the actuating member from the first position to the second position, and simultaneously exerts an upward manual force on the container lid sufficient to overcome the limited resistance to raising the container lid, the user raises the container lid from the container base to open the child-resistant container.

BRIEF DESCRIPTION OF THE FIGURES

The present disclosure can be better understood by referring to the following figures. The components in the figures are not necessarily to scale, emphasis instead being placed upon illustrating the principles of the disclosure. In the figures, reference numerals designate corresponding parts throughout the different views.

DETAILED DESCRIPTION

Figure 1:
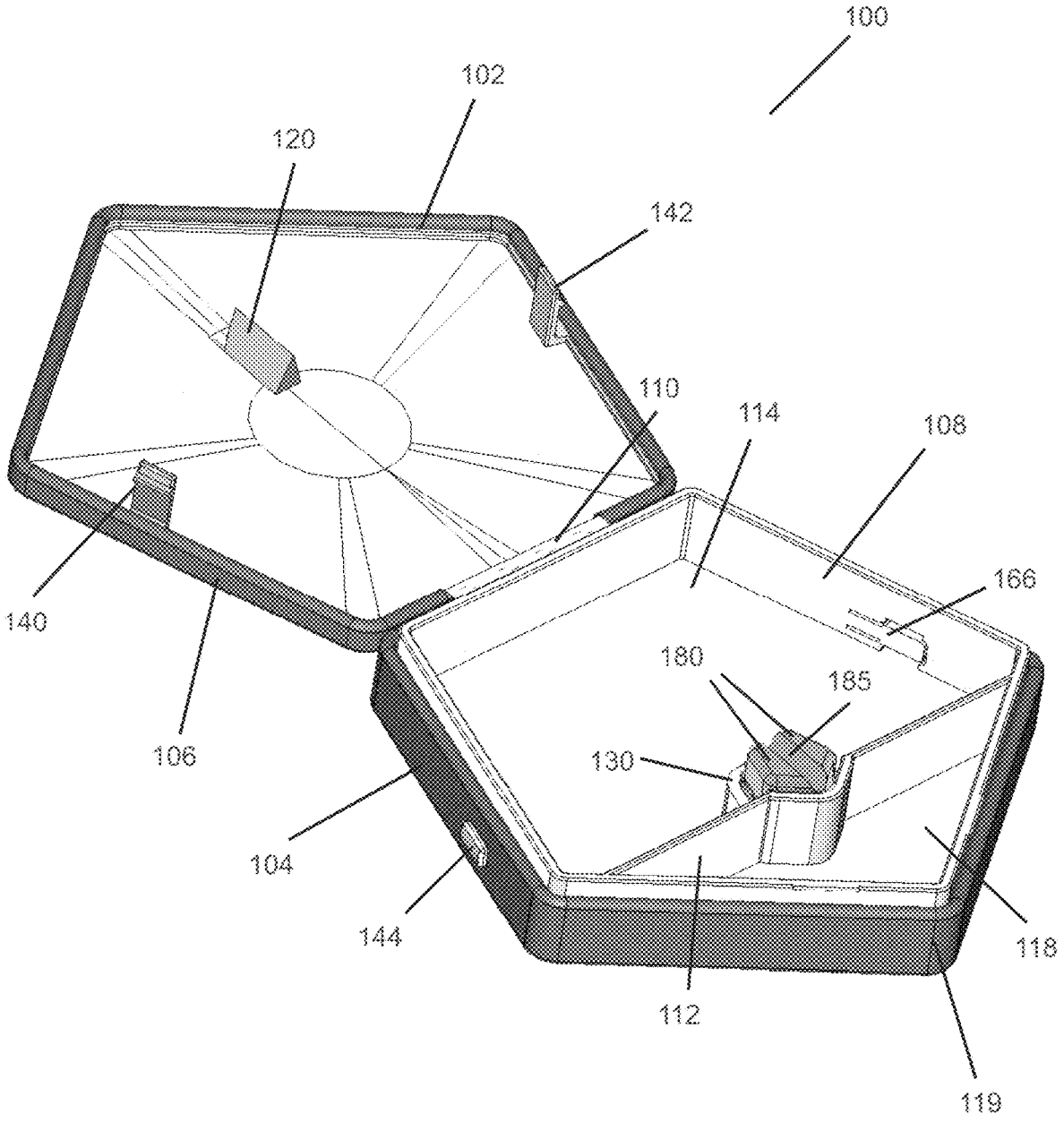
FIG. 1 is a perspective view of a child-resistant container with microdosing mechanisms, viewed from above in opened configuration, according to an embodiment.
Figure 2:
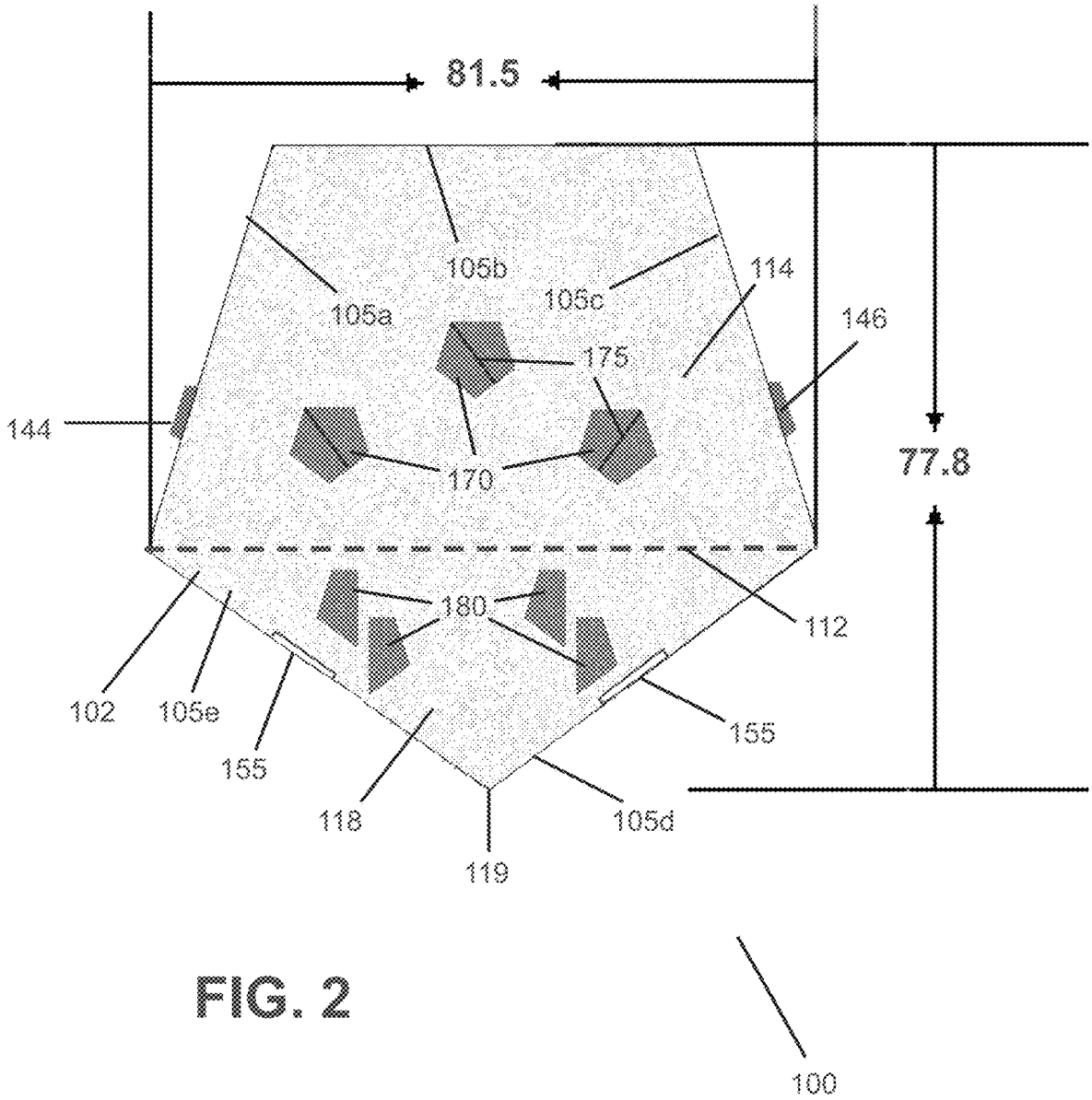
FIG. 2 is a top plan view of a child-resistant container with a pentagonal configuration, according to an embodiment.
Figure 3:
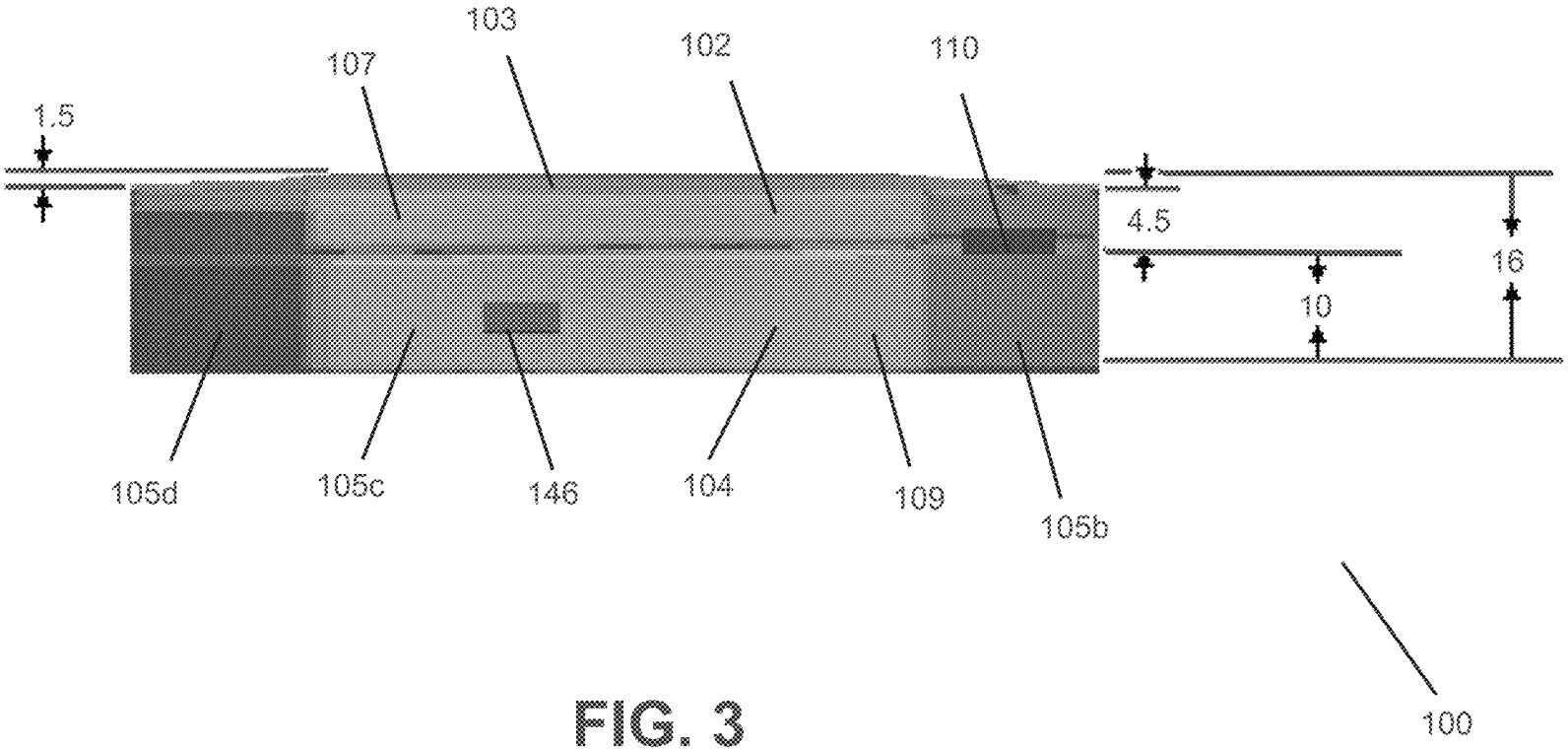
FIG. 3 is a side elevation view of a child-resistant container according to the embodiment of FIG. 2, viewing sides at the rear of the pentagonal container.

The present disclosure is here described in detail with reference to embodiments illustrated in the drawings, which form a part hereof. Other embodiments may be used and/or other changes may be made without departing from the spirit or scope of the present disclosure. The illustrative embodiments described in the detailed description are not meant to be limiting of the subject matter presented here.

The containers of certain embodiments attempt to address a growing demand for child-resistant packaging (also herein called CR packaging) for *cannabis* products and other psychoactive substances. The present disclosure also provides CR packaging that can be opened without undue problems by adults who have been trained in how to access the packaged contents.

Additionally, the containers attempt to address a need for safe and efficacious use of *cannabis* products and similar products, whether for medicinal or recreational purposes, via administration of serving sizes or doses appropriate to given users. A growing number of *cannabis* advocates are pushing for less consumption as opposed to more. This growing trend in *cannabis* consumption is sometimes called "microdosing." For example, some practitioners of microdosing choose to consume small amounts of *cannabis* in order to reap therapeutic benefits of tetrahydrocannabinol (THC) while avoiding psychoactive effects of THC that can interfere with the demands of daily life. In various embodiments, a microdose is defined relative to a threshold dose for a given user. That is, a microdose is a dose of a psychoactive product or medicament below a threshold that creates a perceptible psychoactive effect in that user. Microdosing can result in a sub-perceptual effect that is subtle without markedly influencing the user's mood or mindset. Although the example herein recites microdosing of a product containing *cannabis*, the tin is configured to allow for microdosing of other solid ingestible materials (e.g., pills or mints).

In consumption of marijuana, one common form is solid ingestible materials containing *cannabis*. An example is *cannabis* edibles, i.e., food products that contain cannabinoids, especially THC. Another example is medicaments containing THC. In packaging *cannabis* edibles and THC medicaments, it is desirable to provide serving sizes for edibles, or dosing amounts for medicaments, that are appropriate to the physiology and consumption preferences of given users. Determining the right serving size or dose amount for given users can be challenging since every person reacts differently to ingested cannabinoids. Additionally, *cannabis* compounds can have biphasic properties, i.e., low and high doses of the same compound can produce opposite effects. The containers of the present disclosure address these problems.

As used in the present disclosure, "medicaments" mean solid ingestible substances used for medical treatment. In an embodiment, a medicament includes a pharmaceutically active agent, i.e., a compound or mixture of compounds that produces a physiological result (e.g., a beneficial or useful result) upon ingestion by a human. Pharmaceutically active agents are distinguishable from such components as vehicles, carriers, diluents, lubricants, binders and other formulating aids, and encapsulating or otherwise protective components. Medicaments stored by the containers of the present disclosure may be characterized by their solid physical form and by their route of consumption or administration (i.e., they are taken by mouth and swallowed. to be absorbed into blood permeating the gastrointestinal tract).

The containers of the present invention store ingestible foods or medicaments in discrete physical solid servings or portions. As used in the present disclosure, "portion" means a discrete serving or dosage of a solid ingestible foods or medicament, contained in or removed from the containers of the present disclosure. Alternatively, the present disclosure sometimes uses the terms "product portion," "serving," or "dosage form" in referring to such discrete serving or dosage of a solid ingestible food or medicament. An example of portions of marijuana edibles are *cannabis*-infused mints. In various embodiments, marijuana-infused mints can contain as little as 2.5 milligrams of THC, as well as higher levels such as 10.0 milligrams of THC, which is sometimes considered a serving amount. *Cannabis*-infused mints provide dependable doses of THC and are perfect for microdosing. Other examples of portions of marijuana edibles are discrete baked products such as cookies and brownies. Examples of solid ingestible foods include mints, hard candies, and gum, among others. Examples of solid dosage forms of medicaments are pills, tablets, lozenges, and granules, among others. Although the example of a *cannabis*-infused mint may be used herein, it is intended that the container can be used for any solid ingestible food or medicament.

As used in the present disclosure, the term "psychoactive products," also sometimes called "psychoactive drugs," means solid ingestible products or solid ingestible chemical substances that act primarily upon the central nervous system to alter brain function, resulting in temporary changes in perception, mood, consciousness and behavior. Psychoactive products may include portions, serving sizes, or doses of solid ingestible substances ingested in quantities below a threshold amount that creates a perceptible psychoactive effect in a given user, sometimes herein called microdoses, as well as quantities exceeding this threshold. Exemplary embodiments of psychoactive products packaged in the containers of the present disclosure are *cannabis* edibles, i.e., food products that contain THC, and pills containing THC. A psychoactive drug may be considered a type of pharmaceutically active agent.

FIGS. 1-6C illustrate embodiments of a container 100 of the present disclosure—also herein called "container tin" and "tin"—incorporating a reclosable lid with child-resistant (CR) features. Additionally, container 100 incorporates convenient mechanisms for creating and storing microdoses of psychoactive products, such as foodstuffs or medications. As seen in an opened configuration in FIG. 1, container 100 includes a lid 102 and base 104 pivotally coupled by a hinge 110.

The base 104 includes one or more compartment for storing portions of ingestible products or medicaments, also herein called a storage compartment. In the embodiment of FIG. 1, base 104 includes a first compartment 114 and a second compartment 118, separated by a wall 112 that extends across the interior of the base. In the illustrated embodiment, the first compartment 114 is larger than the second compartment 118. The container 100 has a pentagonal configuration, and the first compartment 114 borders on three sides of the pentagonal base whereas the second compartment 118 borders on two sides of the rectangular base. An edge 119 of the base opposite the side of the container including hinge 100 is sometimes herein referred to as the front edge of the container.

The lid 102 supports first and second latch pins 140, 142, projecting from opposing positions of the lid. The base 104 includes two catch assemblies 165, 166 (one of which is visible in FIG. 1), located at opposing positions of the base 104 aligned with the positions of first and second latch pins 140, 142. When container 100 is closed, as shown in section in FIG. 4, catch assemblies 165, 166 are configured respectively to engage the first and second latch pins 140, 142 to lock the container.

The lid 102 also supports a cutter 120 near the center of the lid's interior face. In various embodiments, the cutter 120 (also herein called cutter blade) is a blade with a V-shaped profile, or a modified V-shaped profile. In the embodiment shown in FIG. 7, the cutter blade 320 has a modified V-shaped profile including a V-shaped tip in combination with a rectangular base, which base can provide additional support for the V-shaped tip. In another embodiment shown in FIG. 18, the cutter blade has a V-shaped profile.

Figure 7:
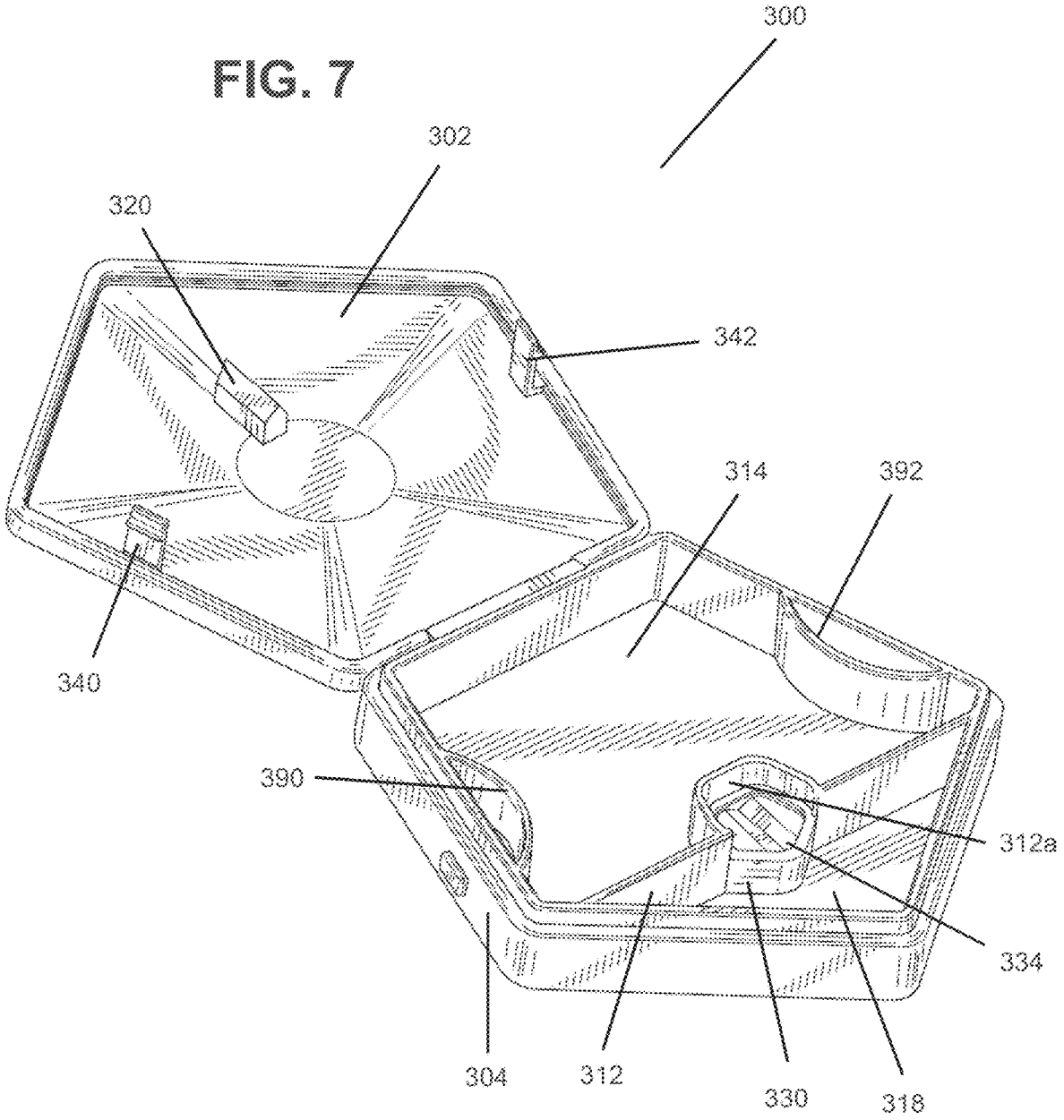
FIG. 7 is a perspective view of a child-resistant pentagonal container with mechanism for creating microdoses, in opened configuration, according to a further embodiment.

FIG. 7 illustrates an embodiment of container 300 that provides various advantages in cutting and storing mints or other solid ingestible products. Container 300 has components generally similar to those of container 100 of FIG. 1 with corresponding reference numerals, with the exception of certain components discussed below. In the container 300, partition wall 312 separates the storage space within container base 304 into a larger compartment 314 and a smaller compartment 318. Container base 304 supports a cutting support table 330 near the center of the base's interior, extending across both sides of the axis of partition wall 312. Cutting support table 330 is aligned with cutter 320 such that when lid 302 approaches a closed position, cutter 320 severs a product or medicament supported by the cutting support table 330. Cutting support table 330 includes a pentagonal receptacle 334, which in combination with a curved segment 312*a* of partition wall 312 is configured to support a pentagonal shaped mint or other portion during the cutting operation. In this example, the cutting support table 330 is configured to receive a particular shaped product, so the cutting support table is configured to have an edge that can hold the product in position and a base that is similar to a bottom side of the product to support the product in an effort to prevent rocking or instability while cutting. The curved segment 312*a* of partition wall 312 separates the pentagonal receptacle 334 from the larger compartment 314, and the pentagonal receptacle 334 is open to the smaller compartment 318. Therefore, cut parts of a product or medicament will tend to fall into the smaller compartment 318, which facilitates the procedure for cutting and storing mints. If cut parts do not fall into the smaller compartment 318, a user may shake the container 300 to allow the cut parts to move from the cutting support table 330.

Additionally, the container 300 includes curved inner walls 390, 392. These inner walls cover catch assemblies (not shown) of container 300 and separate these mechanisms from the compartment 314. Protected spaces defined by inner walls 390, 392 receive latch pins 340, 342 when container 300 is in its closed configuration.

Figure 18:
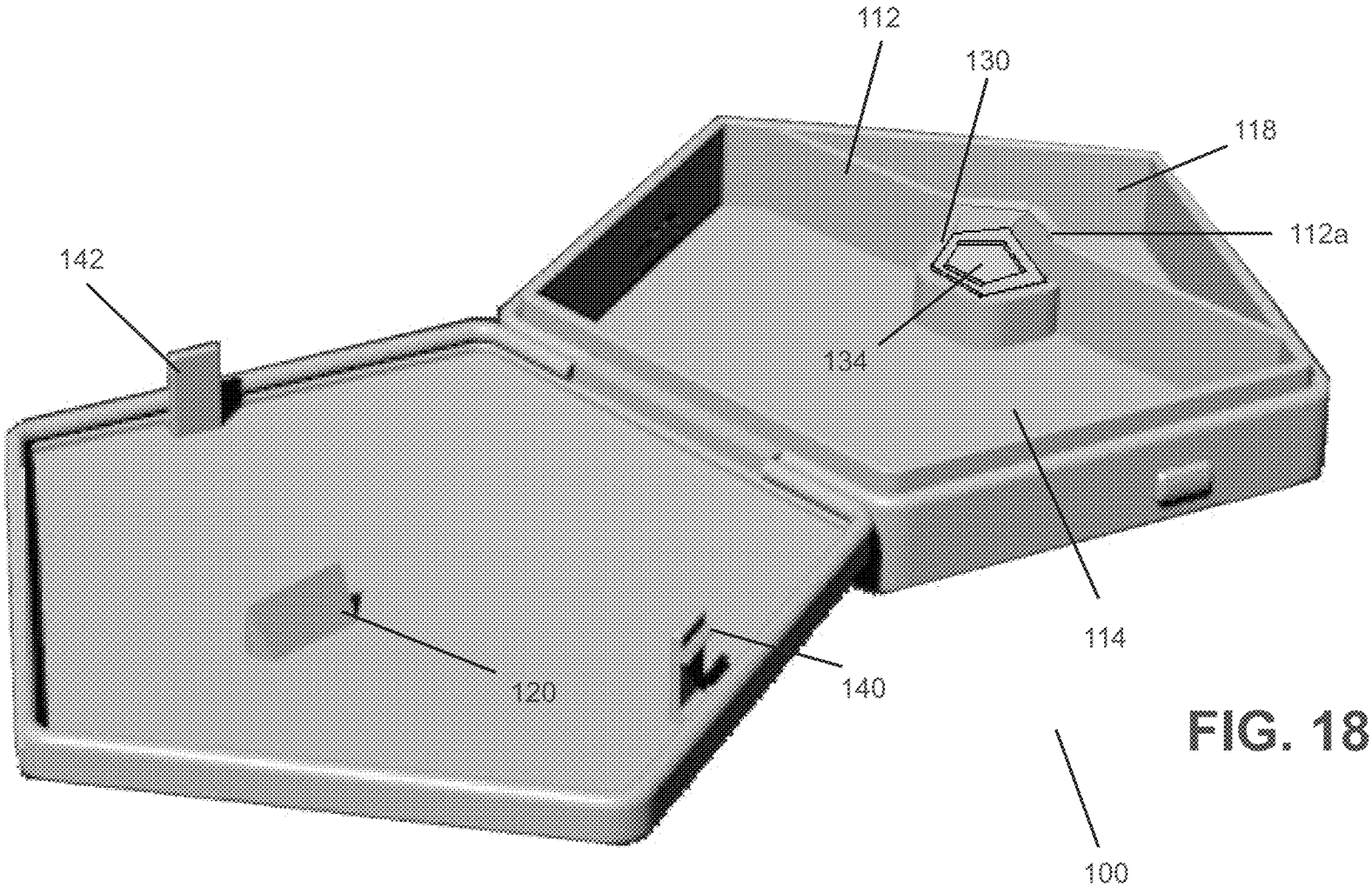
FIG. 18 is a perspective view of a child-resistant pentagonal container with mechanism for creating microdoses, in opened configuration, according to the embodiment of FIG. 1.

FIG. 18 illustrates an embodiment of container tin 100 in opened configuration, generally corresponding to the container 100 of FIG. 1. In the embodiment shown in FIG. 18, the cutting support table 130 is located at the side of wall 112 bordering the larger storage compartment 114. A portion 112*a* of partition wall 112 bordering pentagonal receptacle 134 separates the pentagonal receptacle from the smaller compartment 118, and the pentagonal receptacle is open to larger compartment 114. Therefore, cut parts of a product or medicament will tend to fall into the larger compartment 114, but the user can transfer the cut parts to the smaller compartment 118 if that is the desired storage location.

Referring again to FIG. 2 showing a pentagonal configuration of the container 100, in an exemplary use of container 100 a user removes an ingestible product or medicament portion from a storage compartment in base 104, and places the portion on the cutting support table 130 in order to cut the portion into two parts. The user then closes lid 102, causing the cutter blade 120 to cut or sever the portion into two parts, e.g., two halves. In an exemplary embodiment, the cutting operation severs 175 a pentagon-shaped solid ingestible product such as a *cannabis* infused mint 170 into two parts 180. Optionally, *cannabis* infused mints 170 (or other solid ingestible material) may include score lines 175 to facilitate cutting. In the case of psychoactive products, before cutting, the solid ingestible product has a quantity above a threshold amount that creates a perceptible psychoactive effect in the given user. After cutting, each of the severed parts 180 has a quantity below this threshold. In this embodiment, the cutting procedure creates microdoses of the ingestible product.

In another example, the cutting procedure described above severs a medicament into two halves. Desirably, the dosage form of the medicament is such that while the cutting operation reduces the quantity of active pharmaceutical agent, it does not compromise therapeutic function of other components of the medicament. For example, timed-release administration of active agent from a carrier of the medicament, such as a capsule, can be compromised by cutting the medicament in two. Generally, pills containing cannabinoids such as THC will remain functional after severing the pills in two.

In the illustrated embodiment in which container base 104 includes two storage compartments 114, 118, one of these compartments may be used to store products that have not been cut, while the other compartment may be used to store product parts resulting from cutting, e.g., microdoses. In the embodiment shown in FIG. 2, the larger compartment 114 stores full products, i.e., *cannabis* infused mints 170, and the smaller compartment 118 stores microdoses 180. In an exemplary cutting procedure, the user removes an uncut product from the compartment 114, cuts the product into two product parts or microdoses, and the cut product parts fall into the compartment 118. In another example, the user removes an uncut product from the compartment 114, cuts the product into two product parts or microdoses, and the user deposits the cut product parts into the compartment 118. In an embodiment, given the thickness of mints 170 and cut mint halves 180, container 100 has a limited gap between the partition 112 and the closed lid 102 that prevents the mints or mint halves from moving between compartments 114 and 118 when container 100 is closed.

In various embodiments, the cutting support table 130 may include additional or alternative features. In an embodiment, the cutting support table 130 is configured to permit cutting a portion into more than two parts. In an embodiment, the table 130 is configured to precisely engage a pill for cutting the pill accurately in half. In an embodiment, the cutter 120 and cutting support table 130 are configured to permit simultaneously cutting more than one product or medicament at a time.

Figure 19:
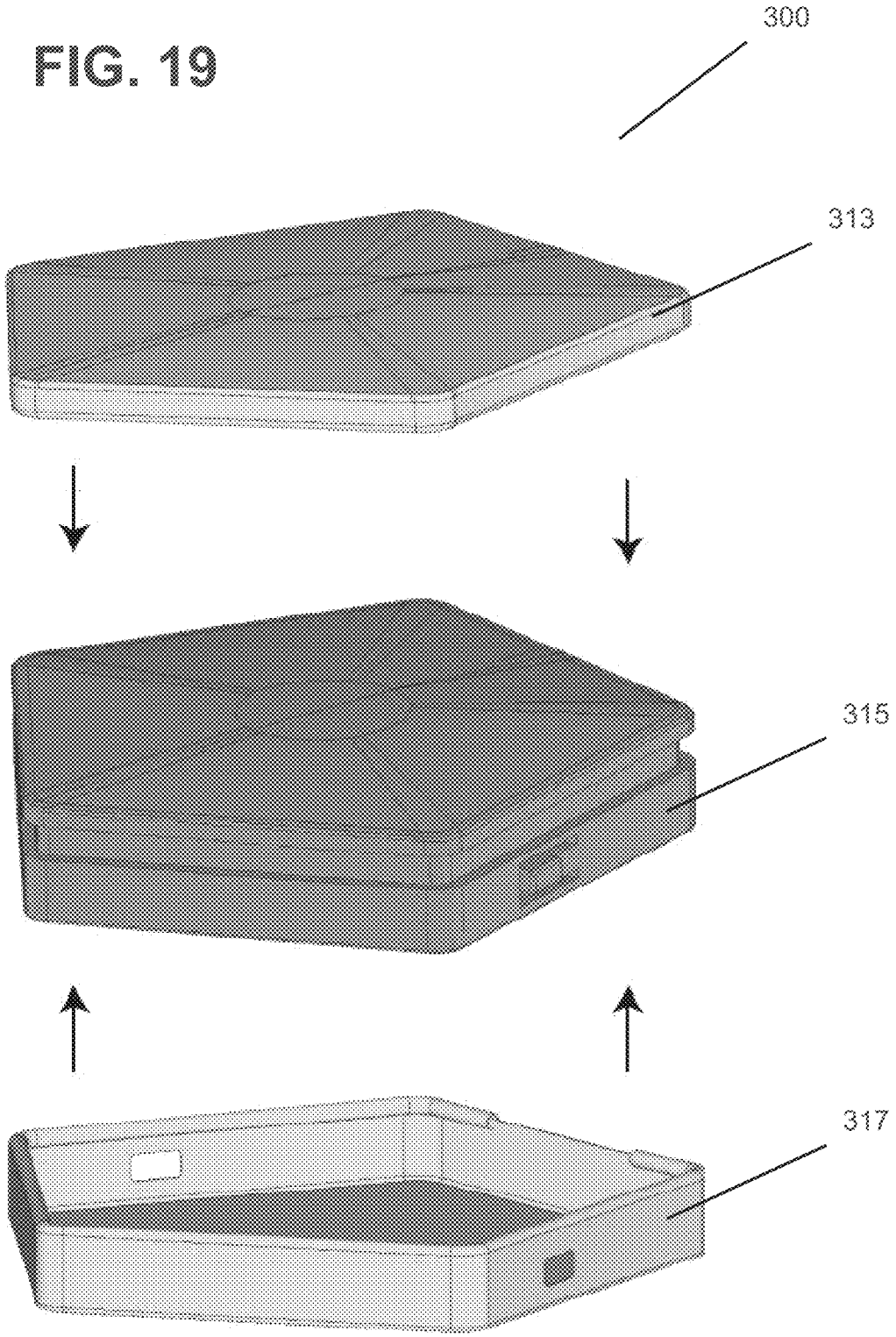
FIG. 19 is an exploded view of major structural components of a metal-plastic container tin, according to the embodiment of FIG. 7.

In an embodiment, exterior structures 106 of container base 104 and lid 102 are formed of metal such as tinplate, while interior structures 108 of lid 102 and base 104 are formed of a plastic material. In an embodiment, the latch pins 140, 142 are formed of an engineering plastic. In an embodiment, the cutter 120 and the cutting support assembly 130 are formed of an engineering plastic. FIG. 19 shows an exploded view of major structural components of a metal-plastic container tin 300 of the type shown in FIG. 7. Container tin 300 includes an enclosed plastic part 315 that houses most functional components of the container. In the assembled container tin 300, plastic part 315 is enclosed within an outer metal lid 313, and an outer metal bottom 317.

In the illustrated form factor, the container 100 is a flat container with a pentagonal shape. Other polygonal or non-polygonal shapes are also possible. As seen in the top plan view of FIG. 2, the pentagonal container (lid 102) includes sides 105*a*-105*e*. Buttons 104, 106, also herein called side buttons, are positioned at opposing positions on sides 105*a* and 105*c*. In an embodiment, the pentagonal shape has a width of around 81.5 mm between laterally opposing corners of sides 105*a*, 105*c* at the widest point of the container. The exemplary shape has a front-to-back distance of 77.8 mm between the back side 105*b* and the front edge 119. In exemplary height dimensions shown in the elevation view of FIG. 3, container 100 has a total height of 16 mm. Segments of the container's height include a 10 mm height of side walls 109 of base 104, a 4.5 mm height of side walls 107 of lid 102, and a 1.5 mm depth of a tapered top surface 103 of lid 102. With these exemplary dimensions, container 100 is a low profile article that can fit into a user's pocket.

Figure 5:
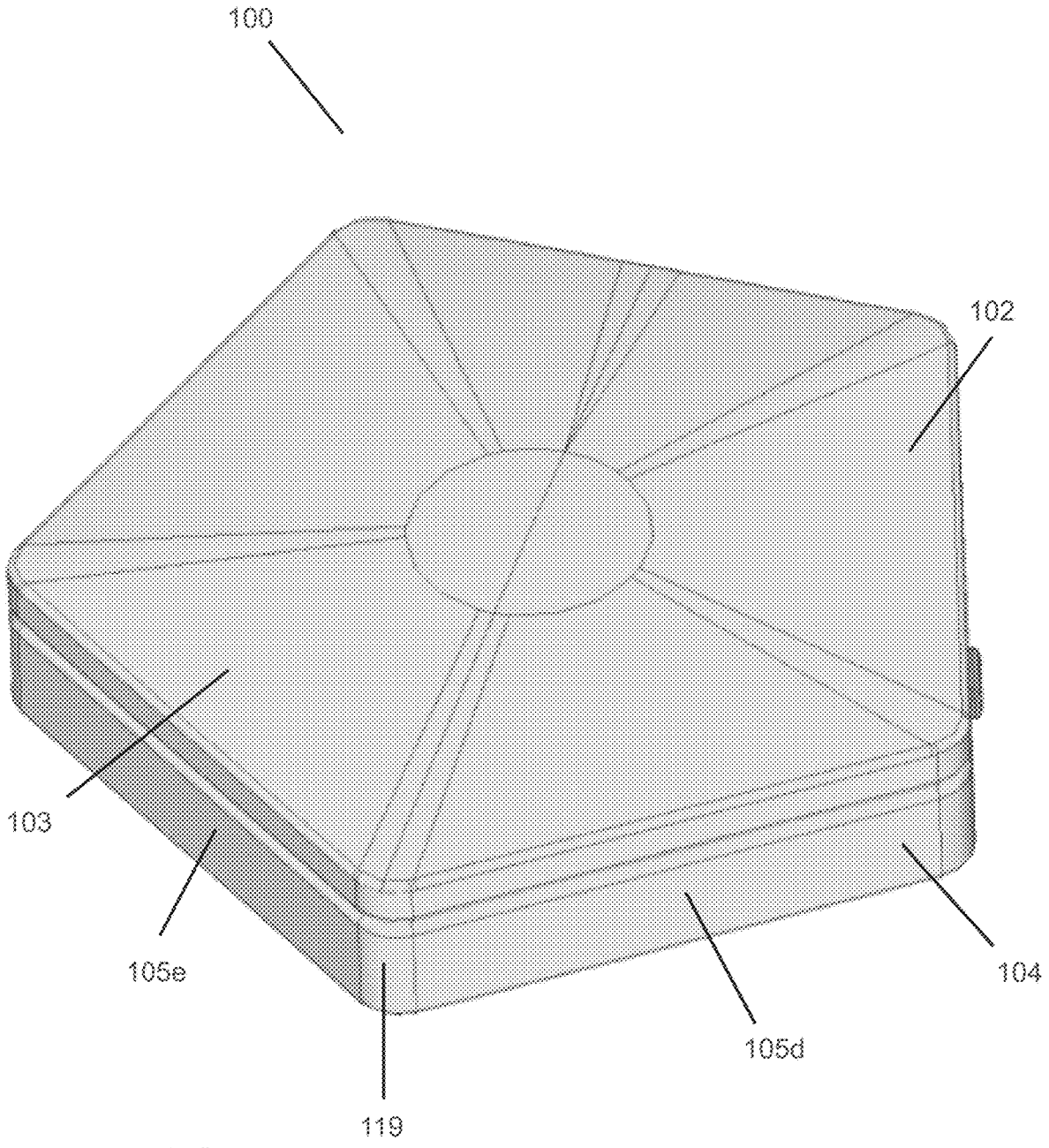
FIG. 5 is an oblique perspective view of a child-resistant pentagonal container with reclosable lid, in closed configuration, viewing sides at the front of the pentagonal container and the top of the container, according to the embodiment of FIG. 1.

As seen in the perspective view of FIG. 5 of the container 100 in its closed configuration, the top surface 103 of lid 102 includes a flat central area that constitutes the uppermost part of container 100, and tapered surfaces extending between this central area and the five sides of the pentagonal container. The front sides 105*d*, 105*e* are shown in this view. The inner surface of lid 102 has a similar contour, as seen in FIG. 1.

Figure 4:
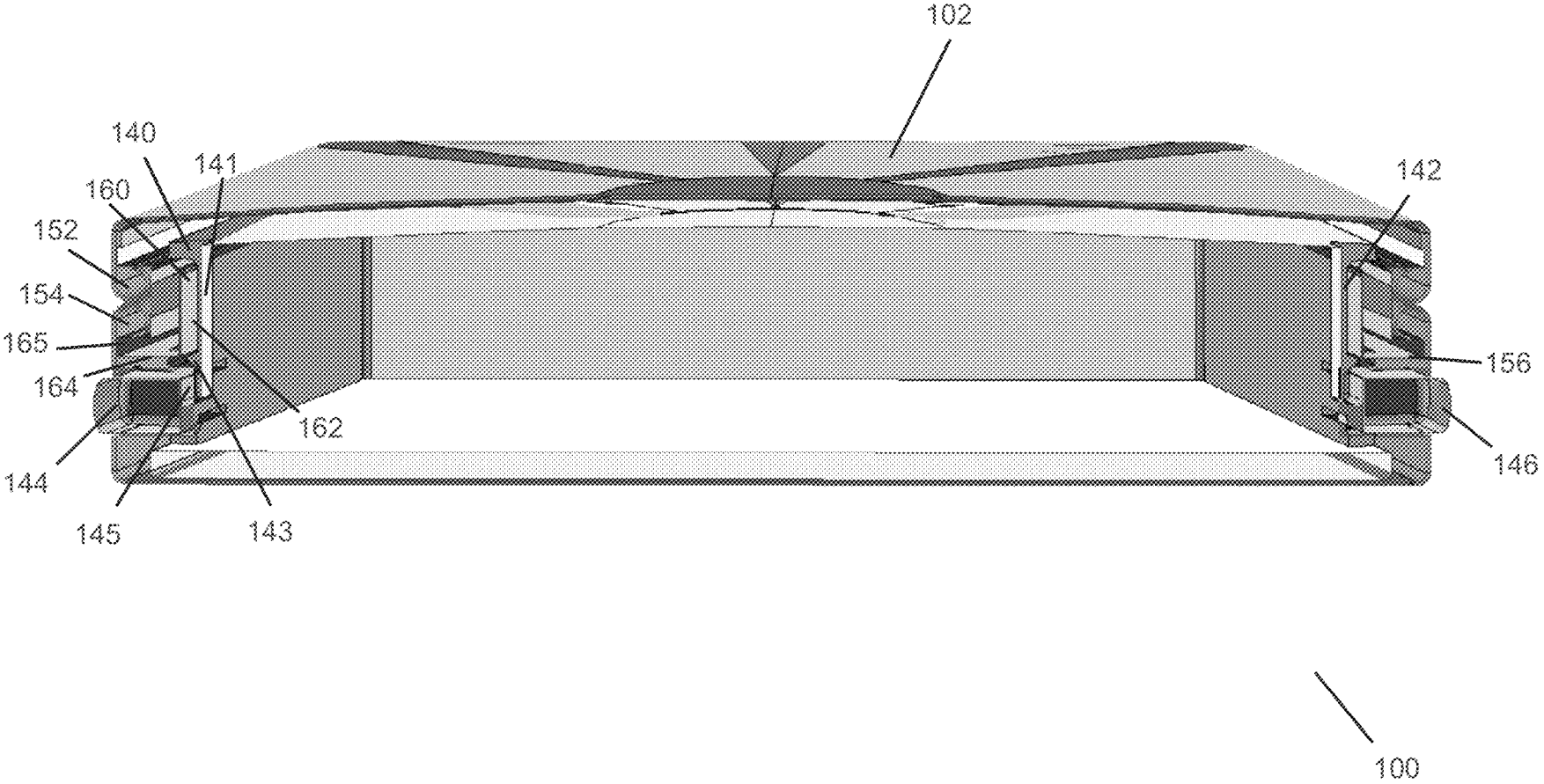
FIG. 4 is a partial cutaway view of a child-resistant container with a reclosable lid, in closed configuration, according to the embodiment of FIG. 1.

FIG. 4 shows a sectional view of the container 100 with the lid 102 in its closed and locked configuration; i.e., configuration in which lid 102 is secured to the base 104. Container 100 includes a child-resistant release mechanism including first and second latch pins 140, 142 that are releasably engageable with first and second catch assemblies 150, 156. Major components of the catch assemblies 150 and 156 include catch plates 160, 168 and side buttons 144, 146, respectively. In the closed and locked configuration of container 100 seen in FIG. 4, latch pins 140, 142 are respectively engaged by the catch plates 160, 168, and prevent raising lid 102 from base 104. Each of side buttons 144, 146 is mounted within base 104 to permit movement between outer positions (also herein called the first position) in which the latch pins can be locked to the catch assemblies, and depressed positions (also herein called the second position) that actuate release or disengagement of the latch pins from the catch assemblies.

Container base 104 includes at its top edge a lip or rim 154 configured for mating engagement with a lip or rim 152 of the lid 102. In an embodiment, lips 152, 154 curl inwardly. First latch pin 140 is a resilient cantilevered structure secured to and extending below a side edge of the lid 102. First latch pin 140 includes a vertically extending arm 141 and a tip 143 at its lower end. The second latch pin 142 has structures corresponding to the latch pin 140. The first catch plate 160 has a modified U-shaped profile that includes an inner side wall 162, a horizontal flange 164, and a short vertical leg 166 that attaches catch plate 160 to a side wall of base 104. When the user closes (lowers) lid 102 onto base 104, tip 143 of latch pin 140 slides downwardly along the inner side wall 162 of catch plate 160 pressing against this surface, until the tip 143 moves below the lower edge of the catch plate. The tip 143 then engages the horizontal flange 164, also herein called the catch surface of container base 104, preventing upward movement of the latch pin 140 and of lid 102. In the embodiment shown, the tip 143 has a substantially trapezoidal configuration, When the user presses side button 144, an inner wall 145 of side button 144 abuts against the arm 141 of latch pin 140. This movement causes the latch pin 140 to flex, such that tip 143 is no longer engaged below horizontal flange 164. Thus, pressing first side button 144 disengages latch pin 140 from catch plate 160, and permits lifting of the lid 102 from that side of container base 104. Container 100 includes corresponding latch and catch mechanisms 142, 156 at the right side of FIG. 4. Pressing the second side button 146 releases the second latch pin 142 from the catch assembly 156 to unlock the lid 102 from that side of container base 104.

In the closed configuration of container 100, the lip or rim 154 of container base 104 is in mating engagement with the lip or rim 152 of lid 102. In an embodiment, container base 104 includes protrusions or nibs 155, e.g., protruding from the inner plastic structure 108 of base 104. Protrusions or nibs 155 may be located at the front edges 105*d*, 105*e* of the container, as shown in phantom in FIG. 2. The protrusions 155 provide an interference fit with the rim 152 of lid 102, to resist raising of the lid 102. By exerting moderate upward force to lid 102 at the front 119 of the container when the latch-catch mechanism is in released configuration, the user can move the lip or rim 152 of lid 102 past the nibs 155 to raise the lid 102.

Figure 6A:
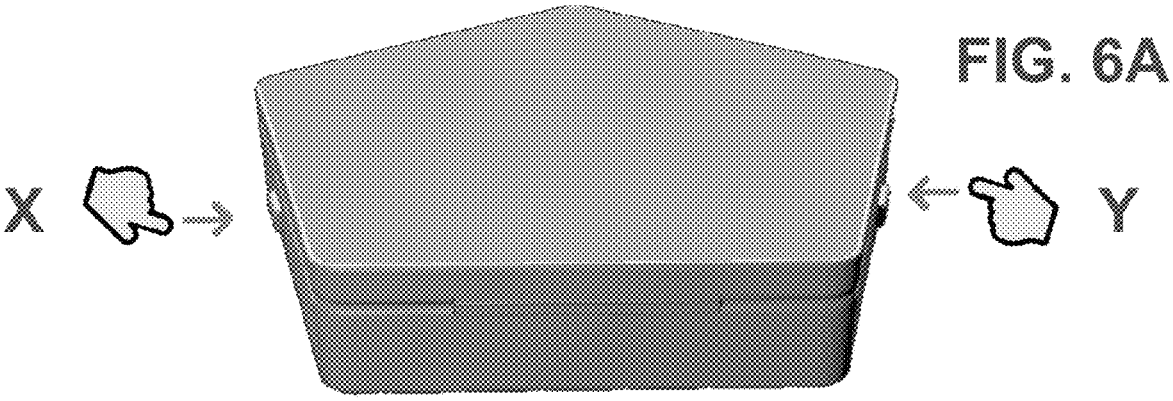
FIGS. 6A-6C are perspective views showing various stages of a child-resistant procedure for opening a reclosable container, according to an embodiment.
Figure 6B:
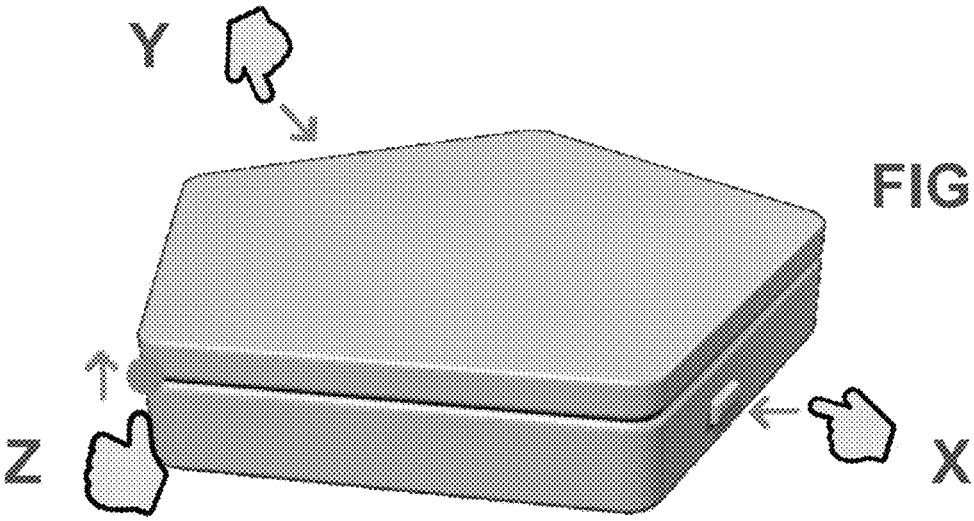
Figure 6C:
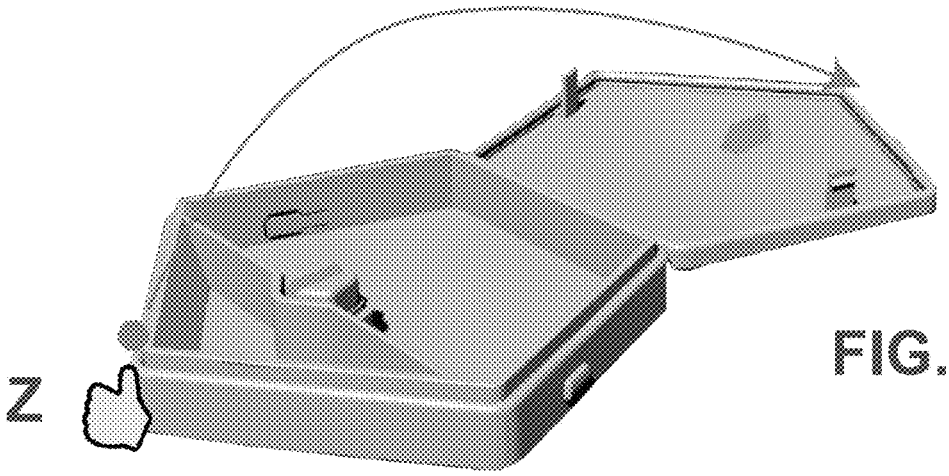

The perspective views of FIGS. 7B, 7C, and 7C illustrate a child-resistant mechanism for opening container 100. Child-resistant reclosable container 100 employs a CR procedure that a properly trained adult can carry out without undue problems to open the container 100, but that presents difficulties to a child attempting to open the container 100. In a first part of the CR procedure, the user simultaneously pushes in the side buttons 144, 146 as shown at arrows X, Y in FIG. 6A. This simultaneous pressing of side buttons 144, 146 moves the first and second latch-catch mechanisms to their released or unlocked configurations. While continuing to simultaneously press buttons 144, 146 as shown at X, Y in FIG. 6B, the user exerts moderate upward force on lid 102 at the front edge of container 100, as shown at arrow Z. This manual force opens the lid 102 to move container 100 to its opened configuration, as seen in FIG. 6C. A user can remove the lid 102 from base 104 by simultaneously effecting this combination of actions, but either of these actions alone is insufficient to open the container 100.

FIGS. 8-17 illustrate embodiments of another container or tin 200 of the present disclosure incorporating a reclosable lid with child-resistant (CR) features. As seen in closed configuration in FIG. 15, tin 200 includes a tin body 240 with a lid 210 secured at the top of tin body 240, also herein called container base 240. In an embodiment, tin body 240 is analogous to the container base 104 of the embodiment of FIGS. 1, 3, but has a tall form factor in contrast to the flat container 100. Container 200 includes a child-resistant release mechanism including button 212. Button 212 (also herein called shift button) is slidably mounted to lid 210 (e.g., at slide 218, FIG. 17) permitting movement as shown at arrow E. Button 212 can be pushed by a user as part of a child-resistant mechanism for opening tin 200 and accessing its contents.

Figure 8:
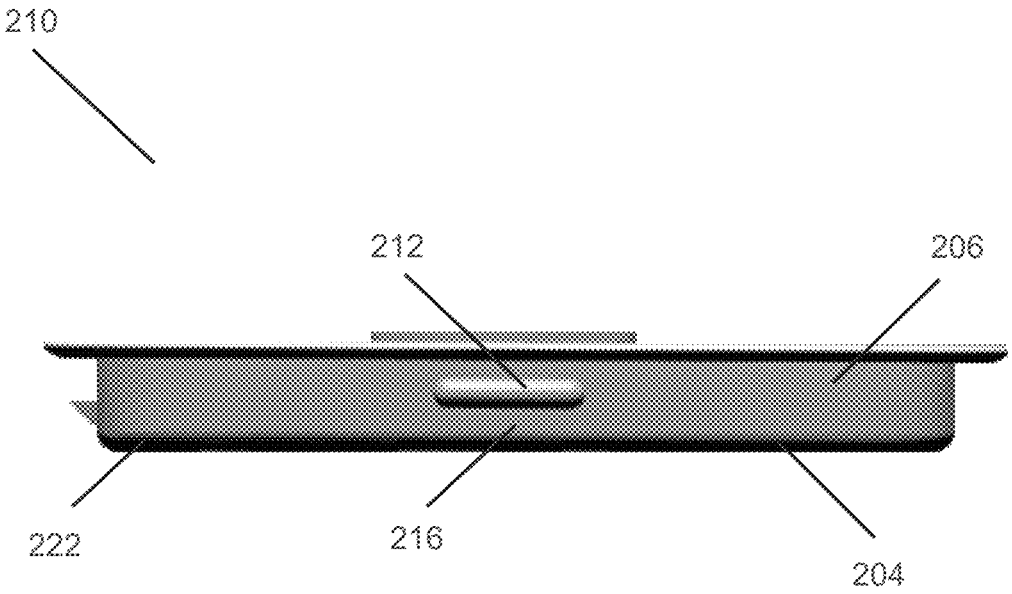
FIG. 8 is an elevation view of a reclosable lid for a child-resistant container tin, in locked configuration, according to a further embodiment.
Figure 9:
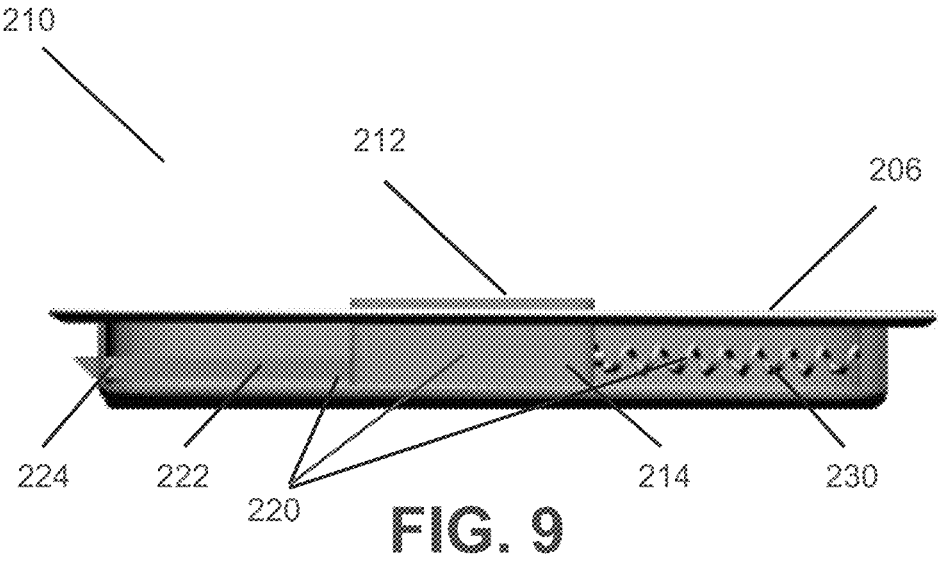
FIG. 9 is a sectional view of a reclosable lid for a child-resistant container tin, in locked configuration, according to the embodiment of FIG. 8.

FIGS. 8 and 9 show in elevation and sectional views the lid 210 in its locked configuration; i.e., configuration in which lid 210 is locked to the top of tin body 240. Lid 210 includes a cover 206 and a lid base 204, these structures being configured to fit snugly at the top of tin body 240. Button 212 includes an upper portion that protrudes above cover 206, and a button base 214 extending within the lid base 204. Button base 214 is joined at its left side to a pin 222, and at its right side to a compression spring 230.

Pin 222, also herein called latch pin, is slidably mounted to a wall of lid base 204, and includes a tip 224 at its end remote from button base 214. Compression spring 230 biases button base 214 toward the left as seen in FIG. 9. In the locked configuration of lid 210, tip 224 of pin 222 protrudes from lid base 204. While in this configuration, the tip 224 of pin 222 interacts with other components of container tin 200 to lock lid 210 within tin body 240. Thus, similarly to the latch pins 140, 142 in the container 100 of FIG. 4, latch pin 222 acts as a primary closure mechanism that prevents raising lid 210 while in the locked configuration.

Figure 10:
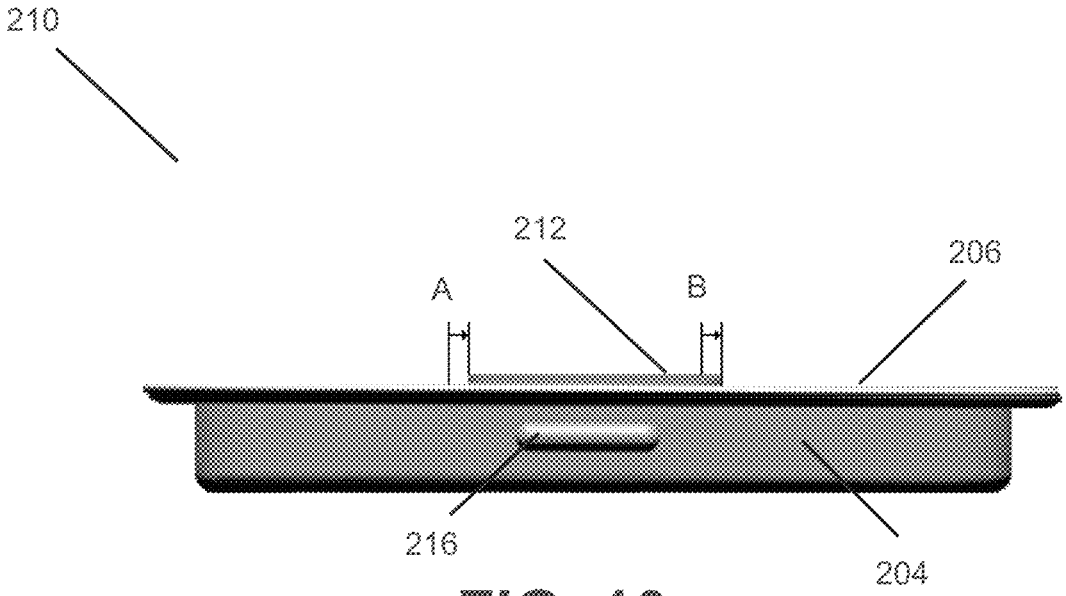
FIG. 10 is an elevation view of a reclosable lid for a child-resistant container tin, in released configuration, according to an embodiment.
Figure 11:
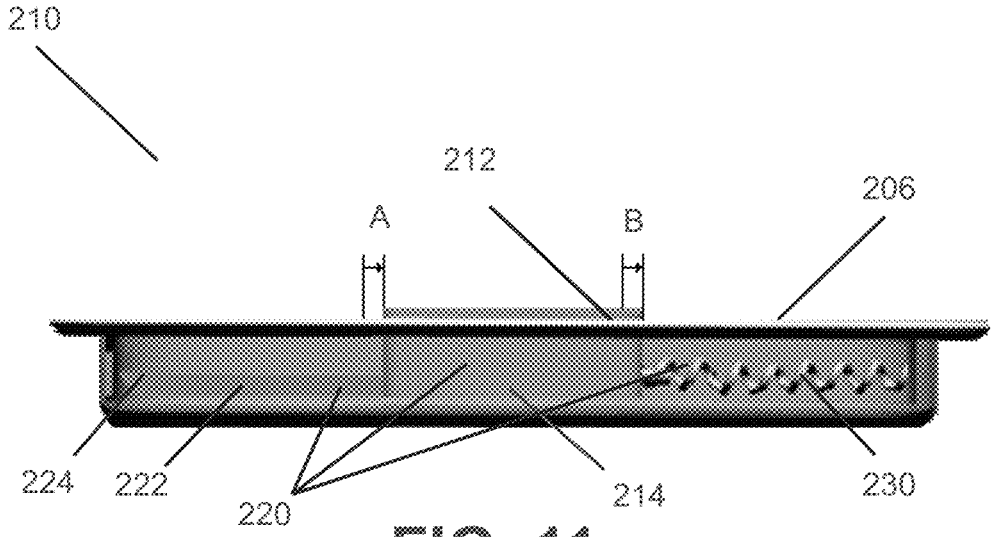
FIG. 11 is a sectional view of a reclosable lid for a child-resistant container tin, in released configuration, according to the embodiment of FIG. 10.
Figure 17:
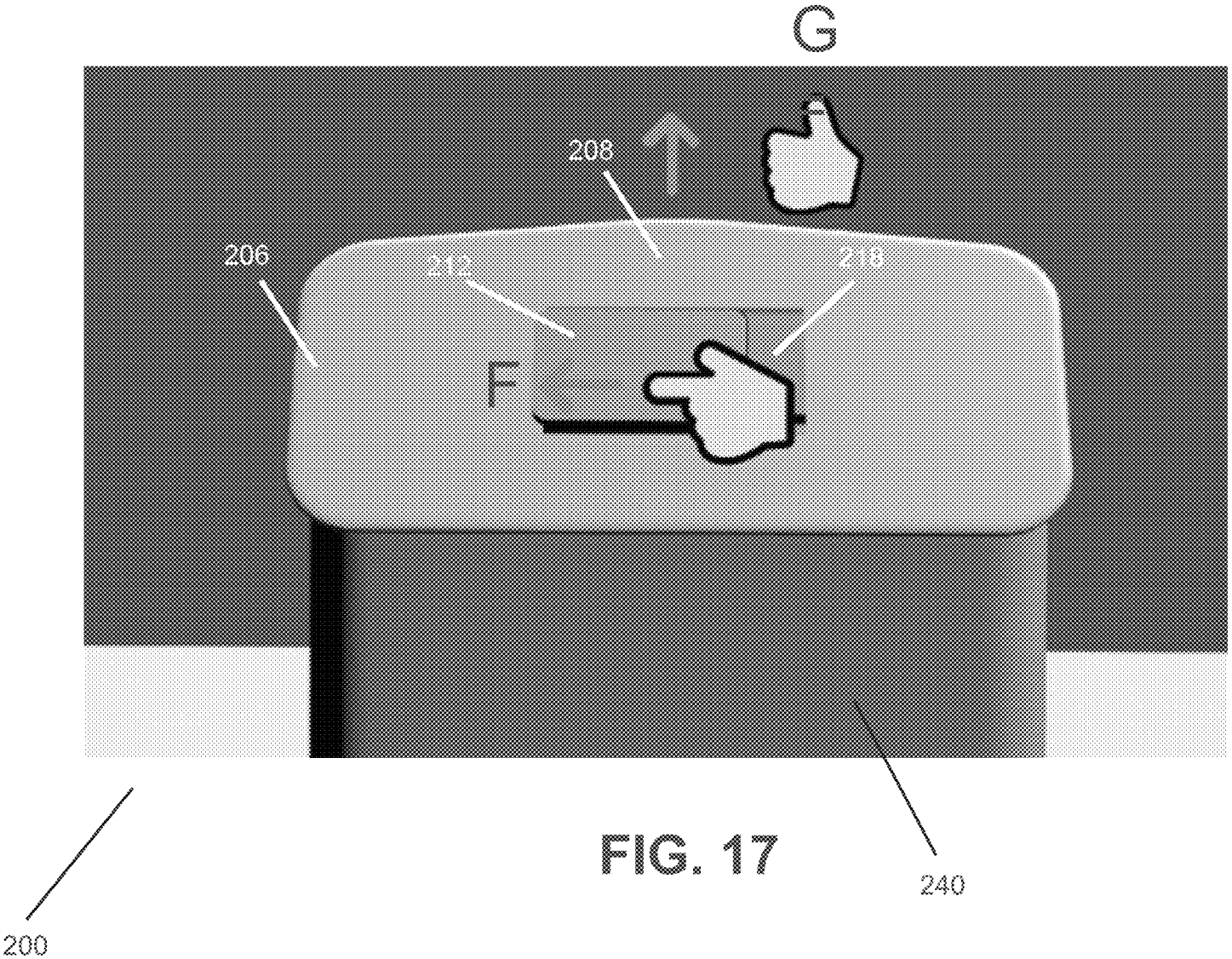
FIG. 17 is a partial perspective view of a child-resistant container tin with lid opened, viewing the top face of the lid, according to an embodiment.

FIGS. 10 and 11 show in elevation and sectional views the lid 210 in its released configuration, i.e., configuration in which lid 210 is no longer locked at the top of tin body 240, thereby permitting opening of tin 200. In this configuration, shift button 212 has been moved to the right by an external force (e.g., manually pushed by a user) as seen in FIG. 17, in displacements shown at arrows A and B. Displacement A of the left end of button body 214 causes the pin 222 to retract so that its tip 224 no longer projects from the lid base 204. In this released configuration, the tip 224 of pin 222 no longer interacts with other components of container tin 200 to lock lid 210 within the tin body 240 of tin 200. Displacement B of the right end of button body 214 compresses the compression spring 230. In an embodiment, when the external force on button 212 is removed, lid 210 reverts to its locked configuration in which compression spring 230 forces button body 214 to move back toward the left (its rest position), causing the tip 224 of pin 222 again to protrude beyond the wall of lid base 204. In both container 200 and container 100, in the absence of a force on the actuating member, the actuating member is biased to its rest position, and the latch mechanism is biased to its locked configuration.

Figure 12:
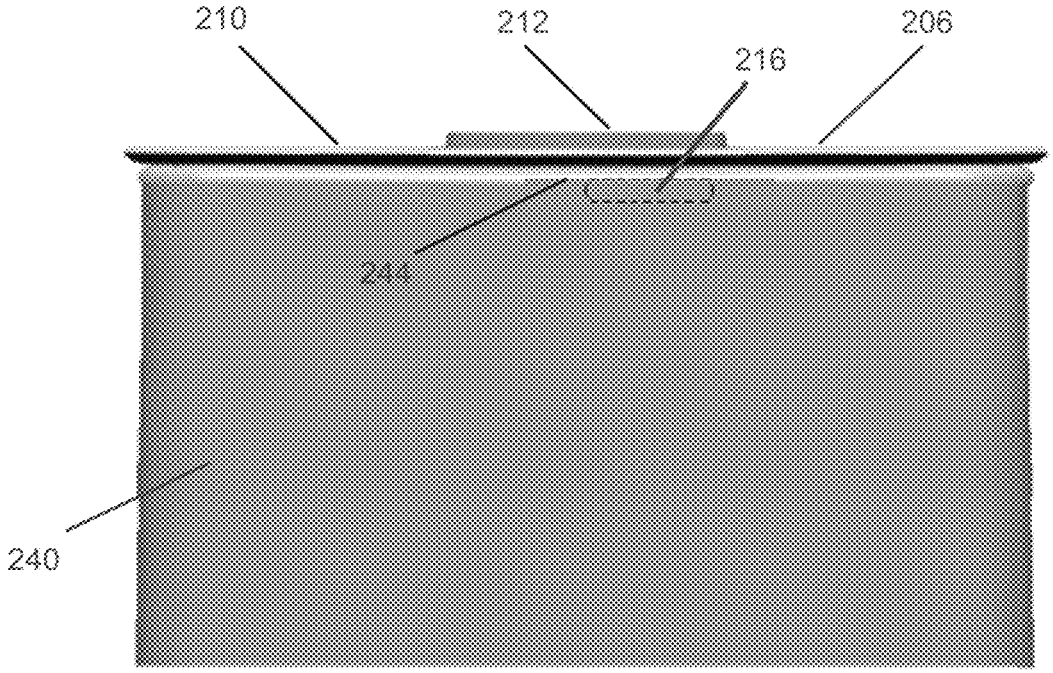
FIG. 12 is a partial elevation view of a child-resistant container tin with a reclosable lid, in closed configuration, according to an embodiment.
Figure 13:
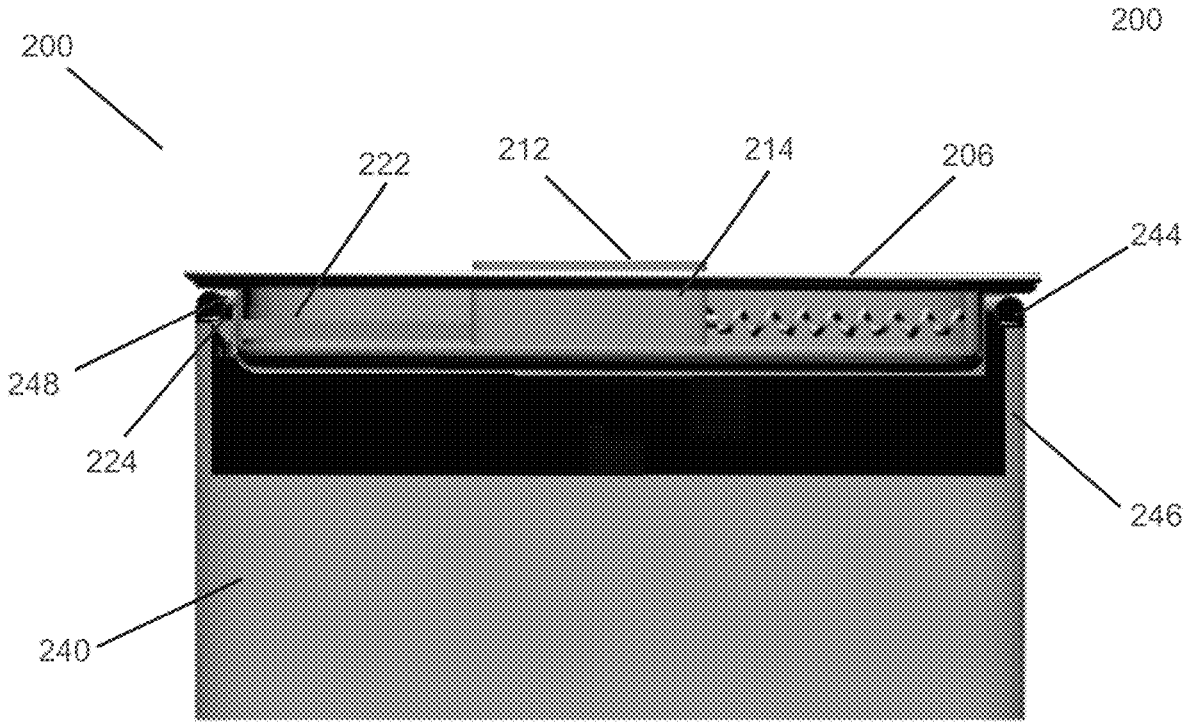
FIG. 13 is a partial cutaway view of a child-resistant container tin with a reclosable lid, in closed configuration, according to the embodiment of FIG. 12.

FIGS. 12 and 13 show structures at the upper end of container 200, seen in its closed configuration with lid 210 in its locked configuration. Container base 240 includes at its top a lip or rim 244 configured for mating engagement with the lid 210. In an embodiment, lip 244 curls inwardly, and includes a bulge or projection 248 that projects over the interior 246 of tin body 240. With lid 210 in its locked configuration, tip 224 of pin 222 protrudes beyond the lid base 204 and abuts against the underside of the bulge 248. The interference between tip 224 and bulge 248 prevents upward movement of the lid 210, and locks the lid within tin body 240. Thus, the bulge 248 serves as a catch surface of container base 240 that is analogous to the horizontal flange 164 in the container 100 in engaging the latch pin while in the locked configuration. In the embodiment shown, the tip 224 has a substantially trapezoidal configuration, projecting furthest at its face that abuts against bulge 248.

With reference to FIGS. 9 and 11, button 212, pin 222, and compression spring 230 are components of a lid release assembly 220. Lid release assembly 220 is one part of a child-resistant (CR) mechanism for releasing lid 210 to open tin 200. Lid 210 also includes at a central region of lid base 204 a nib or protrusion 216. As shown in phantom in FIG. 12, nib or protrusion 216 is configured to engage the lip or rim 244 of tin body 240 to retain the lid 210 within container 200. Thus, in the closed configuration of container 200, the rim 244 of tin body 240 is in mating engagement with the rim 208 of lid 210. The protrusion 216 provides an interference fit with the rim 244 of container base 240 to resist raising the lid 210. This resistance to raising the lid 210 represents a second part of the child-resistant (CR) mechanism of the container 200.

Figure 14:
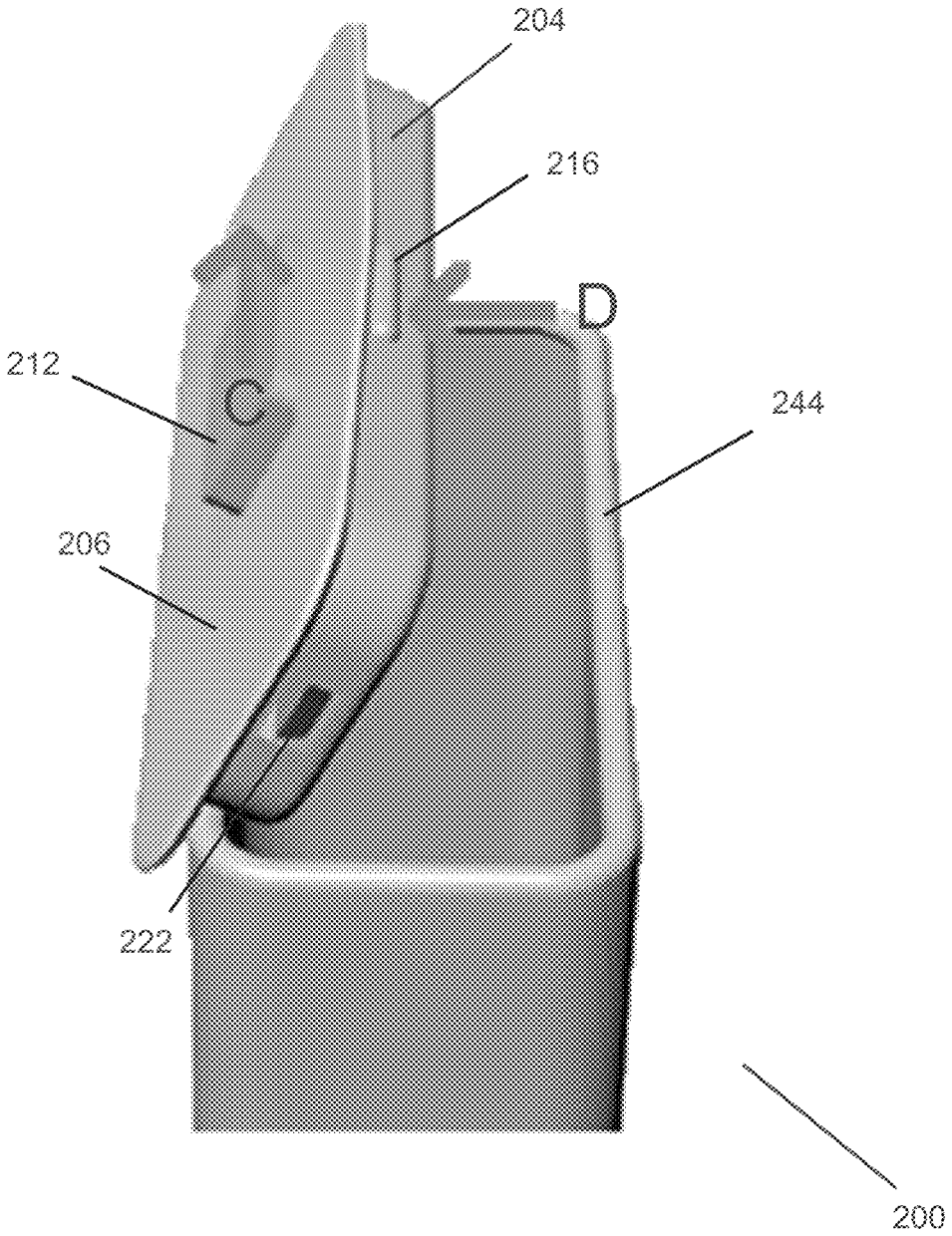
FIG. 14 is a partial perspective view as seen from above of a child-resistant container tin with lid opened, according to an embodiment.
Figure 15:
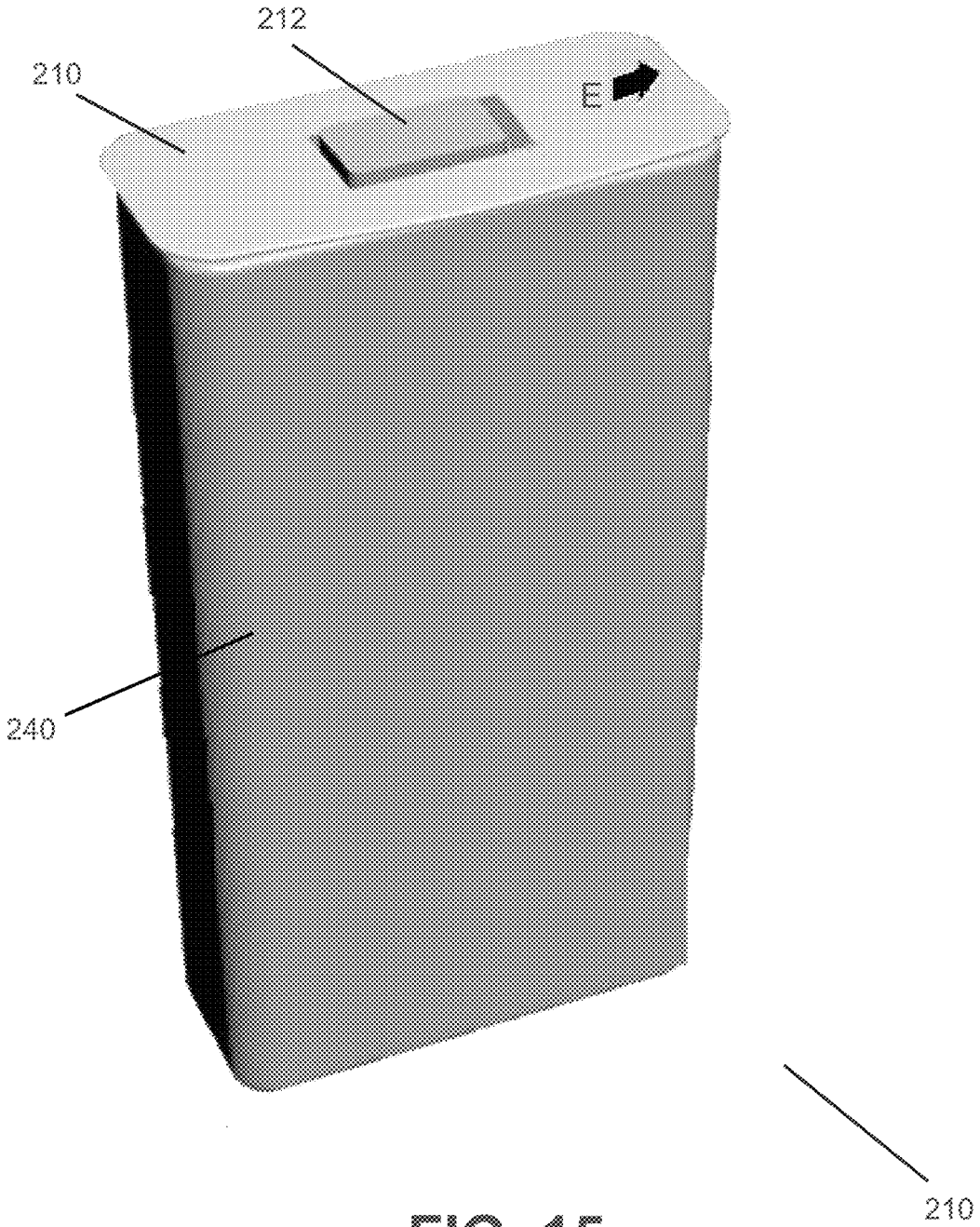
FIG. 15 is an oblique perspective view of a child-resistant container tin with a reclosable lid, in closed configuration, according to an embodiment.
Figure 16:
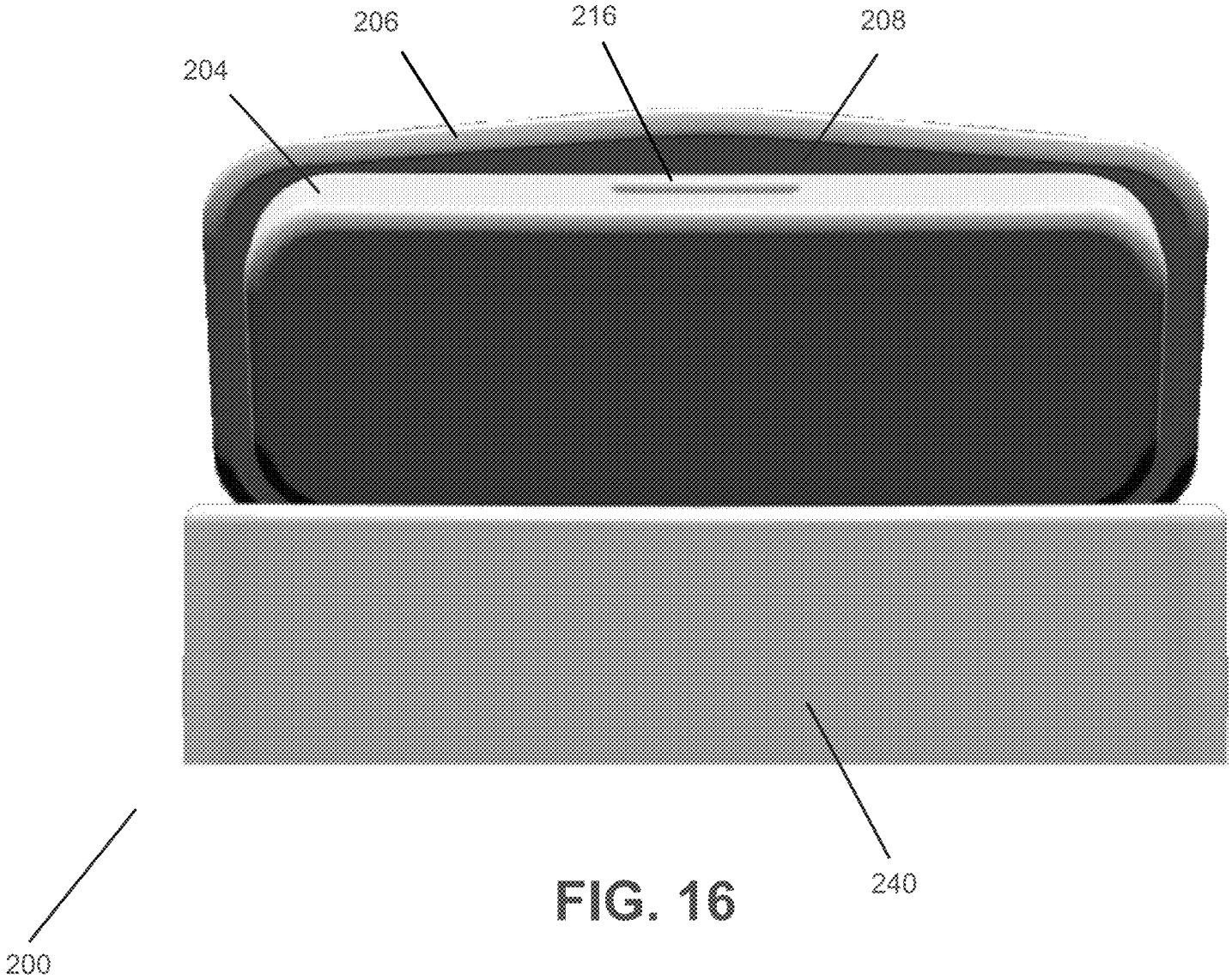
FIG. 16 is a partial perspective view of a child-resistant container tin with lid opened, viewing the bottom face of the lid, according to an embodiment.

Partial perspective views of FIGS. 14 and 17 illustrate the child-resistant mechanism for opening tin 200. The child-resistant reclosable container 200 employs a two-part procedure that a properly trained adult can carry out without undue problems to open the tin 200, but that presents difficulties to a child attempting to open the container 200. In a first part of the CR procedure, the user pushes the shift button 212 to its released position, as shown at arrow C in FIG. 14 and at arrow F in FIG. 17. With references to FIGS. 11 and 12, this movement of shift button 212 moves pin 222 to its retracted configuration within lid base 204. In this retracted configuration, tip 224 no longer abuts against projection 248, thus permitting lid 210 to be removed from tin body 240. Button 212 is analogous to the side buttons 144, 146 in the container 100 of FIG. 4, in that serves as an actuating member for disengaging the latch pin 222 from the catch surface (bulge 248) of container base 240 for converting the container 200 from a locked configuration to an unlocked configuration.

In a second part of the CR procedure, as shown at arrow D in FIG. 14 and at arrow G in FIG. 17, the user grips the lid 210 at rim 208 to lift the lid off tin body 240. By exerting moderate upward force at this location of lid 210 while holding the button 212 in the released configuration, the user can move the protuberance 216 of lid 210 past rim 244 of tin body 240 (FIG. 12) to raise the lid 210. In an embodiment, the lid base 204 is formed of a somewhat flexible material, such as a plastic, to facilitate this procedure. A user can remove the lid 210 from tin body 240 by simultaneously effecting this combination of actions, but either of these actions alone is insufficient to open the container 200.

In an embodiment, container body 240 and lid cover 206 are formed of tinplate, while lid base 204 is formed of a plastic material. In an embodiment, the pin 222 is formed of an engineering plastic. This combination of materials is seen, e.g., in the partial perspective view of FIG. 16 of a child-resistant container tin with lid 210 opened, as seen from a back view of the lid.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

While various aspects and embodiments have been disclosed, other aspects and embodiments are contemplated. The various aspects and embodiments disclosed are for purposes of illustration and are not intended to be limiting.

What is claimed is:

1. A child-resistant container, comprising: a container base including a storage compartment, a first rim and a catch assembly secured to the container base, wherein the catch assembly comprises a first catch surface and a second catch surface located at opposing positions of the container base, wherein each of the first catch surface and the second catch surface comprises a horizontal flange surface of a catch plate at the interior of the container base; a container lid including a second rim and a latch mechanism comprising a first latch and a second latch respectively secured to the container lid, wherein each of the first latch and the second latch comprises a vertically extending arm and a tip at a lower end of the vertically extending arm; and a first button and a second button respectively mounted at first and second sides of the container base, wherein each of the first button and the second button is mounted to permit movement between an outer position and a depressed position within the container base, wherein displacing each of the first button and the second button from the outer position to the depressed position causes the latch mechanism to move from a locked configuration of the container to an unlocked configuration of the container, wherein in the locked configuration the tip at the lower end of a respective one of the first latch and the second latch abuts against a respective one of the first catch surface and the second catch surface to prevent raising of the lid, and in the unlocked configuration the tip at the lower end of the respective one of the first latch and the second latch does not abut against the respective one of the first catch surface and the second catch surface and does not prevent raising of the lid;

wherein in a closed configuration of the container the first rim is in mating engagement with the second rim, and one of the first rim and the second rim includes a protrusion that engages the other of the first rim and the second rim to provide limited resistance to raising the container lid from the container base; and wherein when a user manually displaces each of the first button and second button from the outer position to the depressed position, and simultaneously exerts an upward manual force on the container lid sufficient to overcome the limited resistance to raising the container lid, the user raises the container lid from the container base to open the child-resistant container.

2. The container of claim 1, wherein in the absence of a force on the first button and the second button, the first button and the second button are biased to the outer position and the latch mechanism is biased to the locked configuration.

3. The container of claim 1, wherein the container base comprises a first side wall, a second side wall, and a partition wall that extends continuously across an interior of the base between the first side wall and the second side wall to separate an interior of the container base into a first compartment and a second compartment, wherein the first compartment and the second compartment are configured for storing a plurality of discrete portions of a solid ingestible food or medicament, and further comprising a cutting support member configured in combination with a segment of the partition wall to support one of the discrete portions of the solid ingestible food or medicament during cutting, wherein the container lid is moveably coupled to the container base for movement from an open configuration of the container to a closed configuration of the container, said container lid comprising a cutter configured to cut the one of the discrete portions of the solid ingestible food or medicament supported on the cutting support member into a plurality of parts during the movement from the open configuration of the container toward the closed configuration of the container, and wherein the cutting support member is adjacent the partition wall at a side of partition wall bordering the first compartment, wherein the closed configuration of the container has a gap between the partition wall and the closed container lid that is configured to prevent any of the discrete portions of the solid ingestible food or medicament and the cut one of the discrete portions from moving between the first compartment and the second compartment.

4. The container of claim 3, wherein the container is a reclosable container and the container lid is pivotally coupled to the container base by a hinge for movement between the opened configuration of the container and the closed configuration of the container.

5. The container of claim 3, wherein the cutter is a cutting blade with a shape selected from a V-shape, and a V-shape tip with a rectangular base.

6. The container of claim 3, wherein the first compartment is larger than the second compartment.

7. The container of claim 3, wherein each of the plurality of discrete portions of the solid ingestible food or medicament comprises a product dose and the plurality of parts comprise microdoses of the solid ingestible food or medicament, wherein the cutting support member and the container lid comprising the cutter are configured symmetrically to cut one of the product doses of the solid ingestible food or medicament into the plurality of microdoses of substantially equal dose amount of the solid ingestible food or medicament.

8. The container of claim 3, wherein each of the plurality of discrete portions of the solid ingestible food or medicament comprises a product dose of the solid ingestible food or medicament and the plurality of parts comprise microdoses of the solid ingestible food or medicament, wherein the cutting support member and the container lid comprising the cutter are configured symmetrically to cut one of the product doses into two microdoses of substantially equal dose amount of the solid ingestible food or medicament.

9. The container of claim 3, wherein the cutting support member has edge and base surfaces configured to support in position the one of the discrete portions of the solid ingestible food or medicament of a polygonal shape while the one of the discrete portions is cut.

10. The container of claim 1, wherein the container base comprises a first compartment and a second compartment, separated by a partition wall that extends continuously across an interior of the container base between a first side wall and a second side wall of the container base, wherein the first compartment is larger than the second compartment and each of the first compartment and the second compartment is configured for storing one or more discrete portions of a solid ingestible material, wherein the container lid is moveably coupled to the container base for movement from an open configuration of the container to a closed configuration of the container, and for movement from the closed configuration of the container to the open configuration of the container to access both the first compartment and the second compartment;

further comprising a cutting support member adjacent the wall configured to support one of the one or more discrete portions of the solid ingestible material during cutting; and a cutter configured to cut the one of the discrete portions of the solid ingestible material supported on the cutting support member into two parts during the movement from the open configuration of the container to the closed configuration of the container.

11. The container of claim 10, wherein the cutter is attached to or integral with the container lid.

12. The container of claim 10, wherein the container is a reclosable container and the container lid is pivotally coupled to the container base by a hinge for movement between the opened configuration of the container and the closed configuration of the container.

13. The container of claim 10, wherein the cutter is a cutting blade with a shape selected from a V-shape, and a V-shape tip with a rectangular base.

14. The container of claim 10, wherein each of the one or more discrete portions of the solid ingestible material comprises a product dose and the two parts comprise microdoses of the solid ingestible material, wherein the cutting support member and the cutter are configured symmetrically to cut one of the product doses of the solid ingestible material into the two microdoses of substantially equal dose amount of the solid ingestible material.

15. The container of claim 10, wherein cutting support member has edge and base surfaces configured to support in position the one of the discrete portions of the solid ingestible material of a polygonal shape while the one of the discrete portions is cut.

16. The container of claim 10, wherein the cutting support member is adjacent the wall at a side of the wall bordering one of the first compartment or the second compartment.

* * * * *